US011415384B1

(12) United States Patent
Dvorak

(10) Patent No.: US 11,415,384 B1
(45) Date of Patent: Aug. 16, 2022

(54) GUN VISE

(71) Applicant: Good Sportsman Marketing, LLC, Irving, TX (US)

(72) Inventor: Daniel Dvorak, Henderson, NV (US)

(73) Assignee: Good Sportsman Marketing, LLC, Irving, TX (US)

( * ) Notice: Subject to any disclaimer, the term of this patent is extended or adjusted under 35 U.S.C. 154(b) by 0 days.

(21) Appl. No.: 17/349,768

(22) Filed: Jun. 16, 2021

(51) Int. Cl.
*F41A 23/16* (2006.01)
*F41A 23/18* (2006.01)

(52) U.S. Cl.
CPC ..... *F41A 23/18* (2013.01); *F41A 23/16* (2013.01)

(58) Field of Classification Search
CPC ..... F41A 23/16; F41A 23/12; F41A 23/02; F41A 23/18; F41A 23/14
USPC ..... 42/94
See application file for complete search history.

(56) References Cited

U.S. PATENT DOCUMENTS 5,070,636 A 12/1991 Mueller
5,414,949 A * 5/1995 Peebles ..... F41A 23/16 89/37.04
5,497,575 A * 3/1996 Fried ..... F41A 23/00 89/37.04
6,058,641 A 5/2000 Vecqueray
6,305,117 B1 * 10/2001 Hales, Sr. ..... F41A 23/16 89/37.04
6,526,687 B1 * 3/2003 Looney ..... F41A 23/16 42/94
6,574,899 B1 * 6/2003 Mostello ..... F41A 23/16 42/94
D521,100 S 5/2006 Morrow
D553,219 S 10/2007 Potterfield
7,356,960 B1 * 4/2008 Knitt ..... F41A 23/16 89/37.04
D576,245 S 9/2008 Potterfield
7,584,690 B2 9/2009 Cauley
7,730,824 B1 * 6/2010 Black ..... F41A 23/02 89/37.03
7,774,972 B2 8/2010 Potterfield
7,779,572 B2 8/2010 Potterfield
7,823,317 B2 11/2010 Potterfield
7,845,267 B2 12/2010 Potterfield
7,946,071 B2 5/2011 Cauley
7,954,272 B2 6/2011 Potterfield
7,997,021 B2 8/2011 Cauley
8,011,129 B2 9/2011 Cauley
8,132,351 B2 3/2012 Potterfield
8,296,988 B2 10/2012 Yale
8,316,570 B2 11/2012 Potterfield
8,327,570 B2 12/2012 Potterfield
8,356,442 B2 1/2013 Potterfield
8,393,106 B2 3/2013 Cauley
8,464,628 B2 6/2013 Potterfield
8,516,734 B2 8/2013 Yale
8,578,645 B2 11/2013 Cauley
(Continued)

*Primary Examiner* — Joshua E Freeman
(74) *Attorney, Agent, or Firm* — Lightbulb IP, LLC

(57) ABSTRACT

A gun vise comprises one or more supports that move between a folded state, an extended state, and a locked state. A support is movable in both a sliding and rotating motion via an articulating mount to transition between states. In the locked state, a support is seated within a socket of a base of the gun vise to rigidly hold the support in position. In the folded state, a support has a reduced vertical footprint, such as to facilitate storage and transport.

20 Claims, 5 Drawing Sheets

(56) References Cited

U.S. PATENT DOCUMENTS

| | | | | |
|---|---|---|---|---|
| 8,621,773 | B2 | 1/2014 | Morrow | |
| 8,745,913 | B2 | 6/2014 | Hicks | |
| 8,931,193 | B1 * | 1/2015 | Bogart | F41A 23/16 42/1.06 |
| 8,931,201 | B2 * | 1/2015 | Gianladis | F41A 23/18 42/94 |
| 9,151,561 | B2 | 10/2015 | Morrow | |
| 9,702,653 | B2 | 7/2017 | Cauley | |
| 10,317,162 | B2 | 6/2019 | Morrow | |
| 10,365,069 | B1 | 7/2019 | Tayon | |
| 10,514,225 | B2 * | 12/2019 | Cauley, Jr. | F41A 23/16 |
| 10,962,321 | B2 * | 3/2021 | Wynalda, Jr. | F41A 23/06 |
| 2007/0256346 | A1 | 11/2007 | Potterfield | |
| 2008/0047188 | A1 | 2/2008 | Lindstrom | |
| 2008/0168697 | A1 | 7/2008 | Potterfield | |
| 2010/0126055 | A1 * | 5/2010 | Potterfield | F41A 23/16 206/505 |
| 2011/0197748 | A1 * | 8/2011 | Roberts | F41A 23/16 89/43.01 |
| 2012/0222344 | A1 * | 9/2012 | Werner | F41A 23/16 42/94 |
| 2014/0237882 | A1 * | 8/2014 | Banes | F41A 23/02 42/94 |
| 2019/0271522 | A1 * | 9/2019 | Nousiainen | F41A 23/16 |
| 2020/0033089 | A1 | 1/2020 | Morrow | |
| 2020/0208933 | A1 * | 7/2020 | Wynalda, Jr. | F41A 23/06 |
| 2021/0041202 | A1 | 2/2021 | Cauley | |
| 2021/0293504 | A1 * | 9/2021 | Wynalda, Jr. | F41A 23/06 |

* cited by examiner

GUN VISE

BACKGROUND OF THE INVENTION

1. Field of the Invention

The invention relates to firearm support and in particular to a gun vise.

2. Related Art

Firearm maintenance and repair is an important part of firearm ownership. A firearm may be held by various firearm supports to facilitate maintenance and repair. For example, a firearm may be held for cleaning, part replacement or installation, or the like. A firearm may also be held to facilitate adjustment of its sight or scope or to otherwise improve its performance.

From the discussion that follows, it will become apparent that the present invention addresses the deficiencies associated with the prior art while providing numerous additional advantages and benefits not contemplated or possible with prior art constructions.

SUMMARY OF THE INVENTION

A gun vise for securing various firearms is disclosed herein. As will be further described, the gun vise is extendable to a locked state for use and retractable to a folded state having a reduced footprint, such as to facilitate storage and transport. A gun vise may also be expanded or contracted between an expanded state and a contracted state, to allow a variety of firearms to be secured by the gun vise.

Various embodiments of the gun vise are disclosed herein along with methods relating to the same. For instance, in one exemplary embodiment, a gun vise comprises a frame having an elongated shape, and a base slidably mounted to the frame. The base comprises a socket and an articulating mount. The articulating mount is slidable into and out of the socket and is rotatable.

A first support secures a first portion of a firearm and is attached to the base by the articulating mount. The base may be slidable to expand or contract the horizontal distance between the first support and the second support.

The first support is movable between a locked state, where the first support is seated in the socket, and a folded state, where the first support is generally perpendicular to the first support's locked state, via the articulating mount. The first support may comprise a post member whereby an end of the post member is received in the socket in the locked state. A holding mechanism that releasably secures the base to the frame may be provided as well.

A second support is provided to secure second portion of a firearm. The second support may also be movable between a locked state where the second support is seated in the socket, and a folded state, where the second support is generally perpendicular to the second support's locked state.

The articulating mount may comprise one or more pins and one or more corresponding slots at the socket. One or more risers protruding from the body as well, with the articulating mount being rotatable only when positioned at the risers.

In another exemplary embodiment, a gun vise comprises a base comprising a socket and an articulating mount, with the articulating mount being slidable within the socket and is rotatable. A first support that secures a first portion of a firearm is attached to the base by the articulating mount. The first support is movable between a locked state, where the first support is seated in the socket, and a folded state, where the first support is generally perpendicular to the first support's locked state, via the articulating mount.

The first support may comprise a post member and, in the locked state, an end of the post member may be received in the socket. The end of the post member may be enlarged relative to the remainder of the post member, such as to reinforce the end of the post member.

A second support that secures a second portion of a firearm is also provided. The second support may be movable between an unfolded state and a folded state generally perpendicular to the second support's unfolded state. In addition, the second support may be between a locked state where the second support is seated in a socket, and a folded state, where the second support is generally perpendicular to the second support's locked state.

The gun vise may also include a frame, with the base being slidably mounted to the frame to expand or contract the horizontal distance between the first support and the second support. It is noted that the articulating mount may comprise one or more pins and one or more corresponding slots at the socket. One or more risers may be attached to and protrude from the base, and the articulating mount may be rotatable only when positioned at the risers.

In another exemplary embodiment, a method of securing a firearm with a gun vise is provided, such method comprising rotating a first support of the gun vise from a folded state to an extended state via an articulating mount and moving the first support to a locked state via the articulating mount by sliding the first support into a socket of a base of the gun vise. A first portion of the firearm may be secured with the first support and a second portion of the firearm with a second support rotated to support the firearm.

Similar to above, an articulating mount may comprise one or more pins and one or more corresponding slots at the socket. It is noted that the articulating mount may be rotatable only when in the extended state in some embodiments.

A post member of the first support may be received in the socket in the locked state. In addition, a base of the first support may slide relative to a frame of the gun vise to expand or contract the horizontal distance between the first support and the second support. A base of the second support may slide relative to the frame of the gun vise to expand or contract the horizontal distance between the first support and the second support as well.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

As will become apparent from the disclosure herein, the gun vise may be both extendable and expandable. This allows the gun vise to accommodate various types of firearms while also allowing retraction, contraction, or both to reduce its footprint such as for storage and transport.

Figure 1:
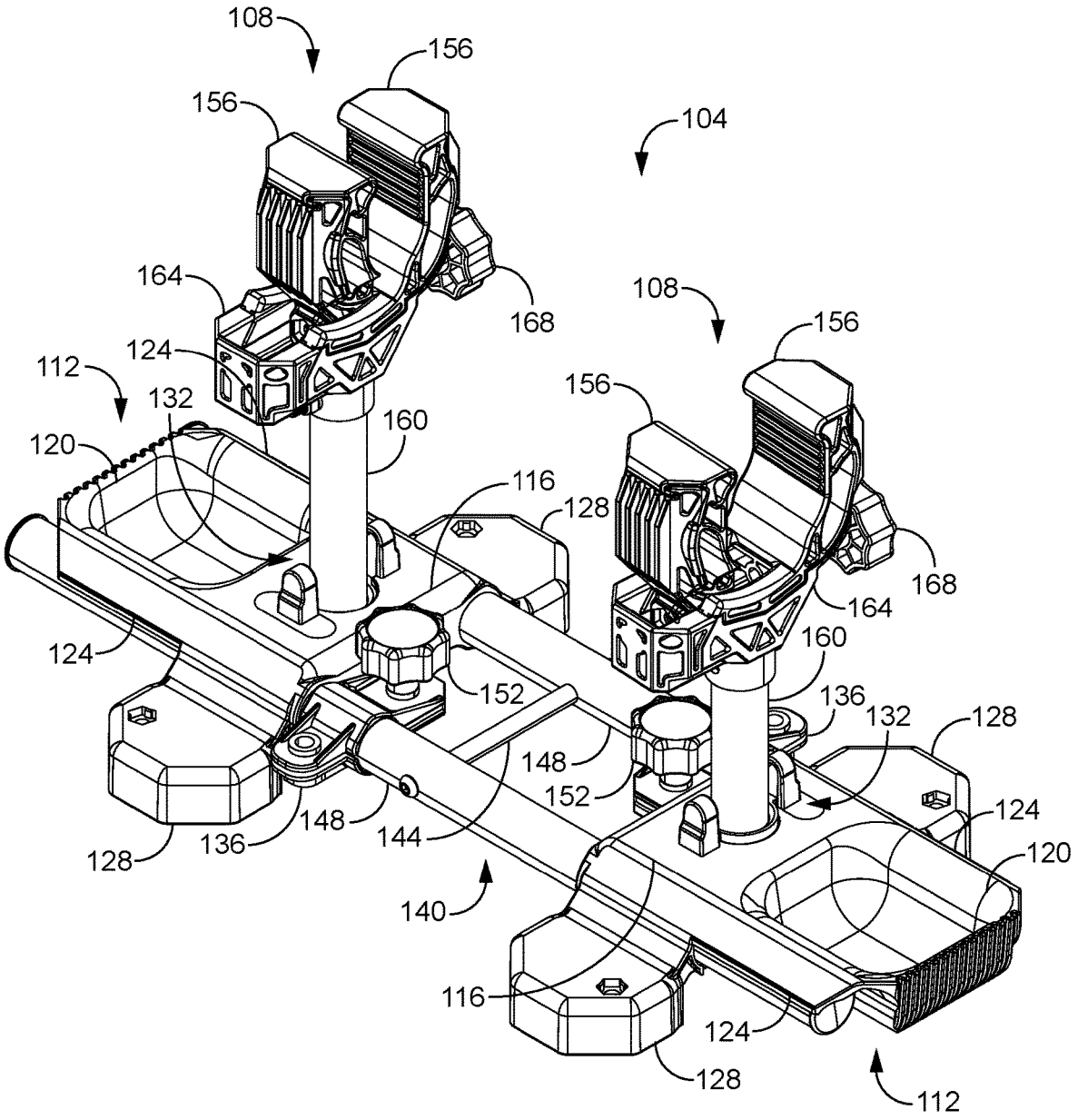
FIG. 1 is a perspective view of an exemplary gun vise in a locked state.

FIG. 1 illustrates a perspective view of an exemplary gun vise 104 in a locked state. The gun vise 104 will typically comprise one or more supports 108 that extend from one or more bases 112. A support 108 may be attached to a base 112 by one or more articulating mounts 132. Typically, a plurality of bases 112 may be secured to one another, such as via a frame 140 as is shown in the embodiment of FIG. 1.

A support 108 will typically be used to clamp or otherwise secure a firearm in place. As can be seen, a support may comprise one or more clamps 164 having one or more jaws 156. A clamp 164 and one or more jaws 156 thereof may be actuated by a clamping mechanism 168, such as a screw-type, quick-release, or other mechanism, to clamp and release a firearm. A clamp 164 may be attached to a post member 160 such as to elevate the clamp when the gun vise 104 is in a locked state.

In one or more embodiments, a base 112 provides a foundation for a gun vise 104. As shown in FIG. 1 for example, a base 112 may comprise a body 116 that may be used to secure one or more articulating mounts 132, one or more feet 128, and other elements of a gun vise 104 as will now be described.

One or more feet 128 may be provided to engage an underlying surface, such as a table. A foot 128 will typically enlarge the footprint of a base 112, such as to stabilize a gun vise 104 relative to an underlying structure. In one or more embodiments, the base 112 may be fastened to an underlying structure, such as at one or more feet 128 or other portion thereof, with one or more mechanical or other fasteners.

A base 112 may also be movable such as to allow its support 108 to be repositioned. In one or more embodiments, a base 112 may slide to expand and contract the distance between individual supports 108, such as to accommodate various firearms. As can be seen, a base 112 may comprise one or more slides 124 that engage one or more corresponding rails 148 of a frame 140. As will be described further below, this permits a base 112 to move, thereby expanding or contracting the distance between individual supports 108, which allows the gun vise 104 to be placed in expanded or contracted states.

A base 112 may also provide one or more accessories. For instance, a base 112 may include one or more storage compartments 120 for convenient storage of firearm parts, tools, or other implements. As shown for example, a compartment 120 is formed in the body 116 of each base 112.

One or more holdfasts 136 will typically be provided to secure bases 112 in position. As illustrated in FIG. 1 for example, a holdfast 136 secures each base 112 to the frame 140 at a desired position. A holding mechanism 152, such as a screw-type, quick-release, or other mechanism, may be used to engage and disengage a holdfast 136, thereby securing or releasing its base 112, respectively speaking.

In one or more embodiments, a frame 140 may be an elongated structure. As described above, a frame 140 may comprise one or more rails 148 to which one or more bases 112 may be slidably mounted. Rails 148 may be secured to one another, such as by one or more crossmembers 144. Rails 148 will typically be mounted such that they are parallel to one another. In one or more embodiments, crossmembers 144 may be centrally positioned so as to not obstruct movement of a base 112 along a rail 148.

Figure 2:
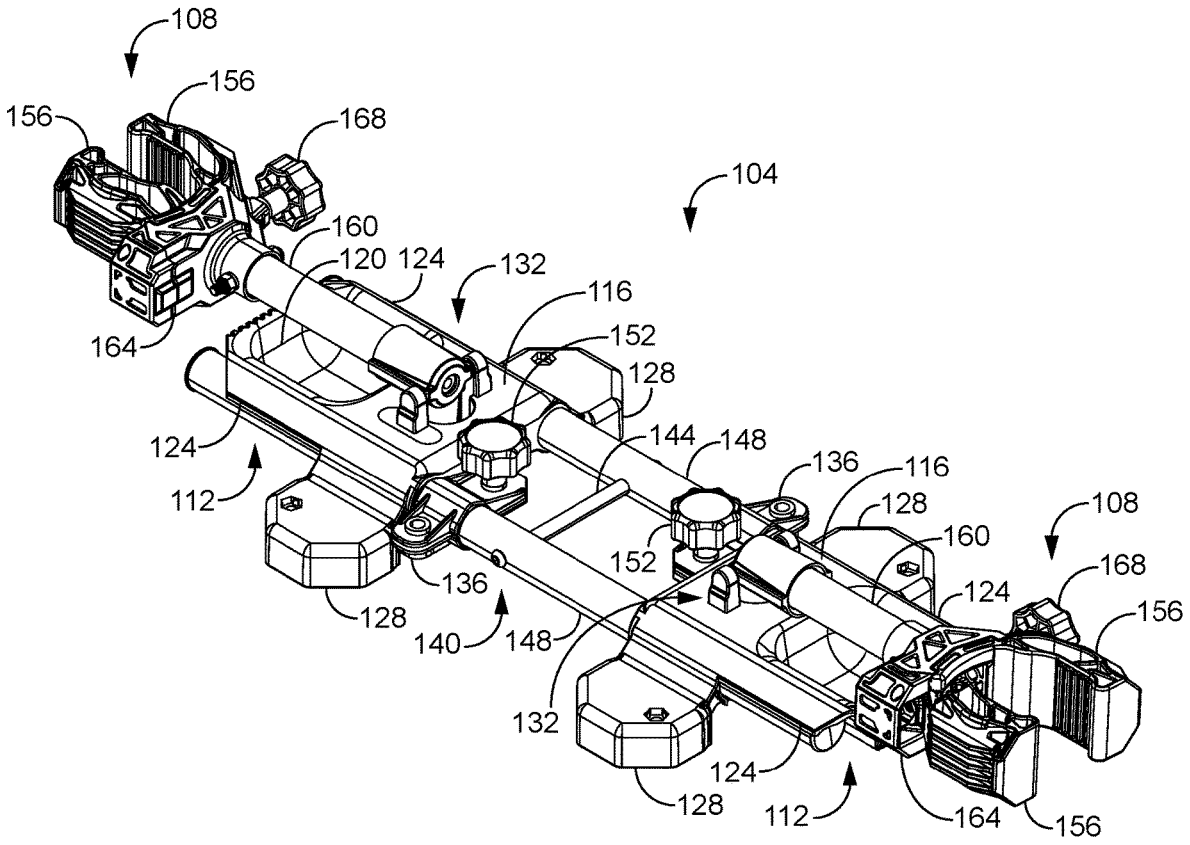
FIG. 2 is a perspective view of an exemplary gun vise in a folded state.

FIG. 2 illustrates an exemplary gun vise 104 in a folded state. As can be seen, a support 108 may articulate via its articulating mount 132 to a folded state. In a folded state, a gun vise 104 has a flattened volume which allows for the gun vise to be conveniently transported or stored. In one or more embodiments, a support 108 may be locked in a folded state, such as via one or more straps, clips, magnets, or other fasteners to keep a gun vise 104 in the folded state.

Figure 3:
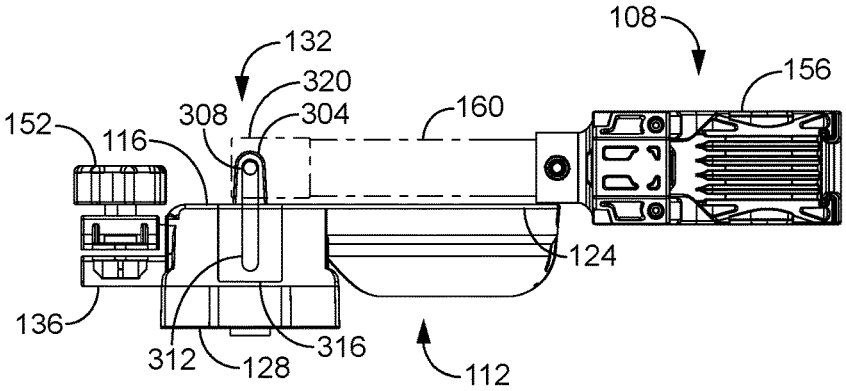
FIG. 3 is a side view of an exemplary support in a folded state.
Figure 4:
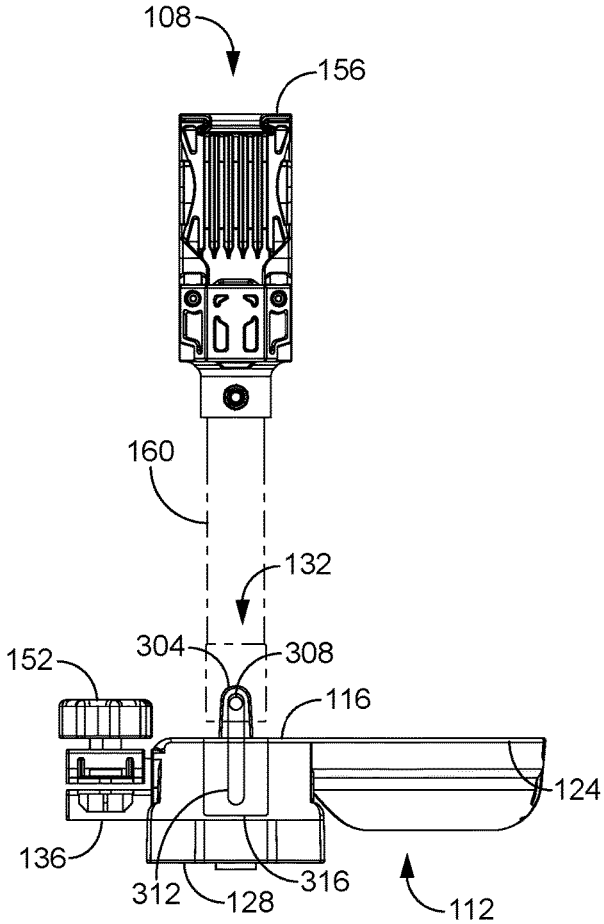
FIG. 4 is a side view of an exemplary support in an extended state.
Figure 5:
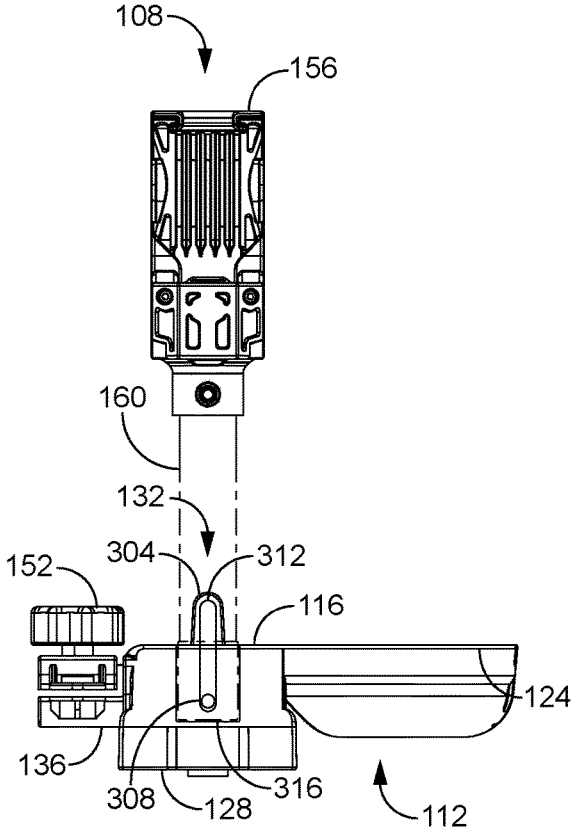
FIG. 5 is a side view of an exemplary support in a locked state.

FIGS. 3-5 illustrate operation of an exemplary articulating mount 132 through cross-sectional side views thereof, the opposite side view being a mirror image thereof. Namely, FIGS. 3-5 respectively illustrate an exemplary articulating mount 132 and support 108 transitioning between a folded state, an extended state, and a locked state.

As can be seen, an articulating mount 132 will typically be capable of compound motions, such as rotational and translational motion, which allows a support 108 to rotate and translate as well. As will be described further below, this is advantageous in securing a support 108 in a locked position, while also allowing the gun vise 104 to be folded.

In one or more embodiments, an articulating mount 132 may comprise a pivot that rotatably attaches a support 108 to a base 112. A pivot may be slidable as well, such as along a guide, to allow the support 108 to articulate both by rotation and translation. As shown for example, the pivot comprises a pin 308 that engages one or more corresponding slots 312, whereby the pin 308 can rotate within as well as slide or otherwise move along the slot 312.

An articulating mount may also include one or more risers 304. A riser 304 will typically provide a structure that protrudes from a base 112 to allow a slot 312 to extend beyond the base. As shown for example, the slot 312 extends from a bottom end within the socket 316 of the articulating mount 132 to terminate at a top end at the riser 304.

To move a support 108 to a locked state from a folded state, the support 108 may be rotated to an extended state, such as shown in FIG. 4, from a folded state, such as shown in FIG. 3. A support 108 may be generally horizontal in the folded state and generally vertical in the extended state. As can be seen, the support 108 disengaged from a socket 316, allowing the articulating mount 136 and support 108 to rotate.

As can also be seen, a pin 308 may rotate in its corresponding slot 312 when a support 108 is moving between states. When moving a support 108 between a folded state and an extended state, the pin 308 will typically rotate in the slot 312 at the riser 304.

To move to a locked state, a support 108 may be inserted into a socket 316, such as shown in FIG. 5. The elongation of the slot 312 accommodates the translational movement of the pin 308 into the socket 316, allowing the support 108 to be received in the socket. It is noted that, once a pin 308, a support 108, or both engages a socket 316, rotational motion will typically no longer be possible.

Once seated, the support 108 will typically be secured in a generally vertical orientation, with the structure of the body 116, namely the socket 316, holding it in position and preventing lateral movement or rotation. This provides a rigid structure for securing firearms.

As can be seen, a portion of a support 108, namely a post member 160, may be received in a socket 316 when seating the support. It is contemplated that a post member 160 may be more substantial or otherwise reinforced at its proximal end where the post member engages a socket 316. As shown for example, the post member 160 has an enlarged section at its proximal end.

To return a support 108 to a folded state, the support may be removed from the socket 316, such as by moving the support out of its socket 316, thereby unseating the support. This translational motion returns the support 108 to an extended state, such as shown in FIG. 4. As can be seen, the pin 308 may be moved back to the riser 304 as the support 108 is removed from the socket 316. When disengaged from its socket 316, the support 108 can be freely rotated to a folded state, such as shown in FIG. 3.

Figure 6:
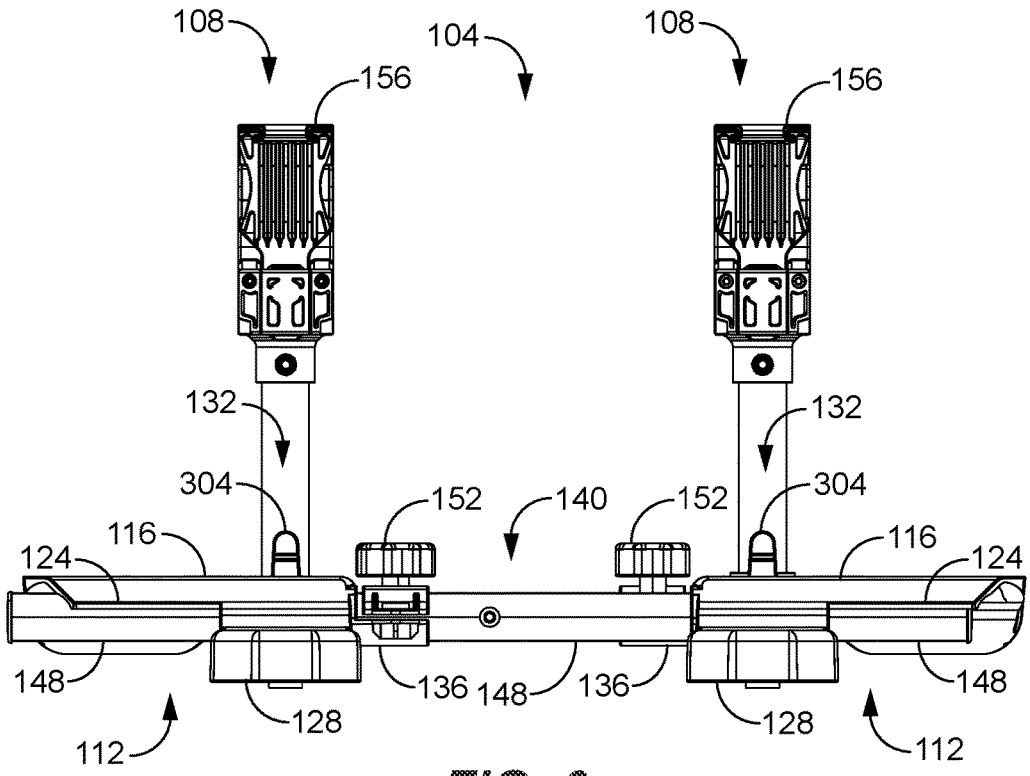
FIG. 6 is a side view of an exemplary gun vise in a contracted state.
Figure 7:
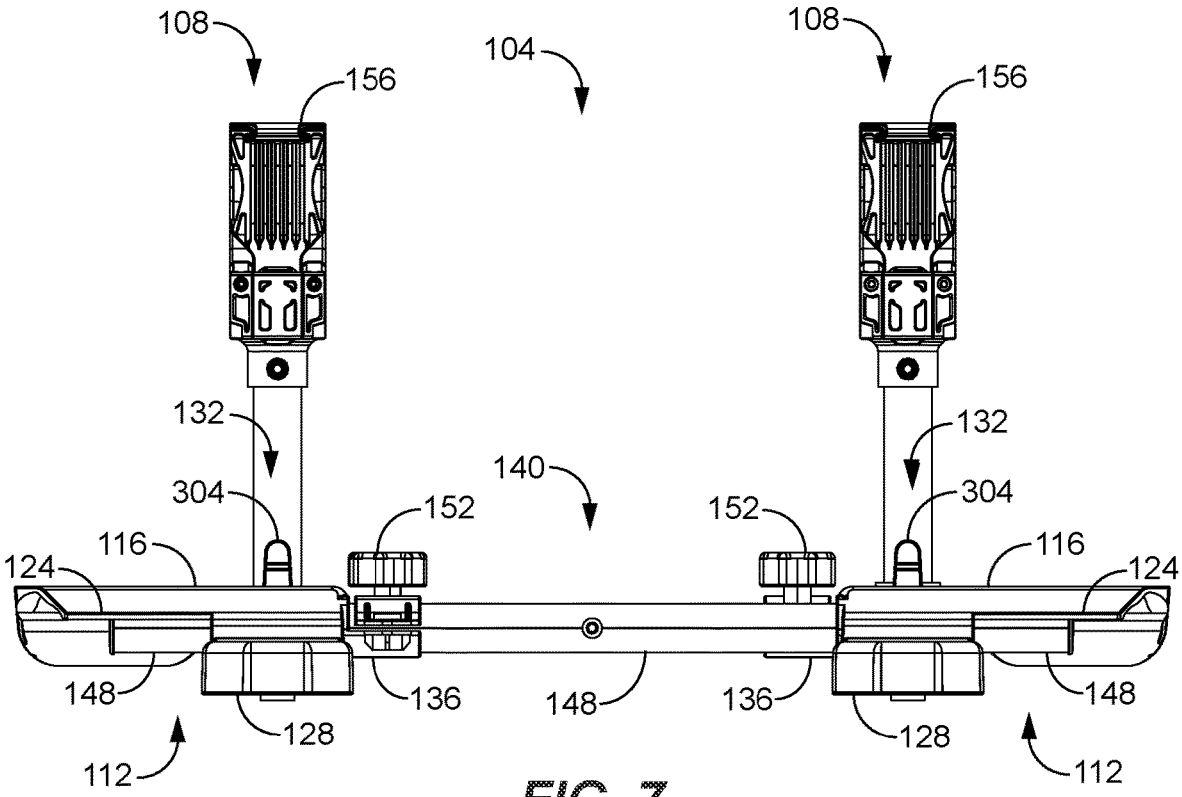
FIG. 7 is a side view of an exemplary gun vise in an expanded state.

The expanded and contracted states of a gun vise 104 will now be described with respect to FIGS. 6 and 7. In general, the expanded and contracted states define the horizontal footprint of a gun vise 104, while the locked and folded states define the vertical footprint of a gun vise.

It can be seen that supports 108 may be moved toward or away from one another to expand or contract a gun vise 104, respectively speaking. As described above, a base 112 may move along a rail 148 to accomplish the same. In one or more embodiments, a slide 124 of a base 112 may receive a rail 148 and guide movement of the base 112 along the rail.

A slide 124 may be shaped to receive a rail 148 in one or more embodiments. As shown in FIGS. 6 and 7 for instance, a slide 124 may have a concave shape to receive the peripheral shape of the rail 148. One or more friction reducing materials may be placed therebetween to facilitate movement along a rail 148. It is contemplated that various sliding mechanisms may be utilized to provide expansion and contraction of a gun vise 104.

In one or more embodiments, a base 112 may be secured to a rail 148 at various points along the rail. This allows expanded and contracted states of varying sizes to be used. To illustrate, a contracted state, such as shown in FIG. 6, may be used for handguns for example, while an expanded state, such as shown in FIG. 7, may be used for carbines and rifles. In an expanded state, bases 112 and any feet 128 thereof will be further apart, thereby appropriately stabilizing the gun vise 104 depending on the size of the firearm secured thereto.

Figure 8:
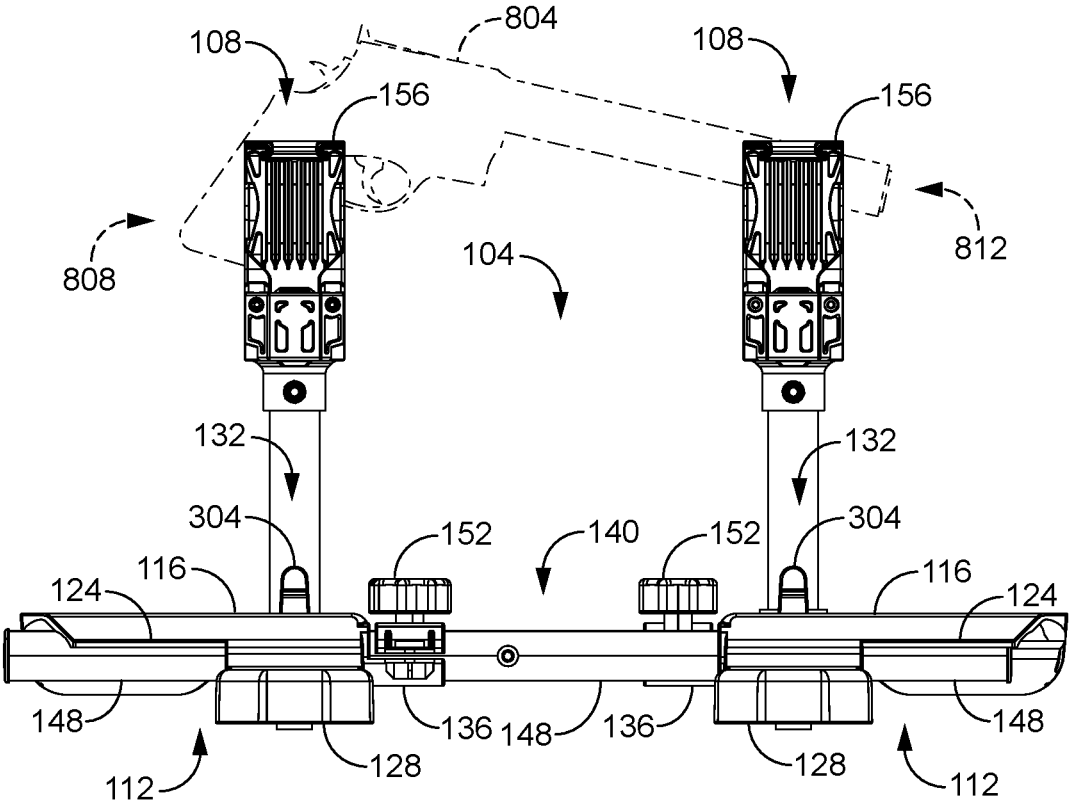
FIG. 8 is a view of an exemplary gun vise in use.

FIG. 8 illustrates an exemplary gun vise 104 in use. As can be seen, a firearm 804 may be secured by one or more clamps 156 of each support 108. Various maintenance, repair, sighting, upgrade, and gunsmithing activities or the like, can then be performed on the firearm 804.

A barrel end 812, butt end 808, or other portion, of a firearm 804 may be independently secured by individual supports 108, such as shown. Though illustrated with a handgun, it will be understood that a variety of firearms 804 may be secured by one or more supports 108 of a gun vise 104.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A gun vise comprising:

a frame having an elongated shape;

a base slidably mounted to the frame, the base comprising a socket and an articulating mount, wherein the articulating mount is slidable into and out of the socket and is rotatable;

a first support that secures a first portion of a firearm, the first support attached to the base by the articulating mount, wherein the first support is movable between a locked state, where the first support is seated in the socket, and a folded state, where the first support is generally perpendicular to the first support's locked state, via the articulating mount; and a second support that secures a second portion of a firearm.

2. The gun vise of claim 1, wherein the articulating mount comprises one or more pins and one or more corresponding slots at the socket.

3. The gun vise of claim 1, further comprising one or more risers protruding from the body, wherein the articulating mount is rotatable only when at the one or more risers.

4. The gun vise of claim 1, wherein the first support comprises a post member and an end of the post member is received in the socket in the locked state.

5. The gun vise of claim 1, further comprising a holding mechanism that releasably secures the base to the frame.

6. The gun vise of claim 1, wherein the base is slidable to expand or contract the horizontal distance between the first support and the second support.

7. The gun vise of claim 1, wherein the second support is also movable between a locked state where the second support is seated in the socket, and a folded state, where the second support is generally perpendicular to the second support's locked state.

8. A gun vise comprising:

a base comprising a socket and an articulating mount, wherein the articulating mount is slidable within the socket and is rotatable;

a first support that secures a first portion of a firearm, the first support attached to the base by the articulating mount, wherein the first support is movable between a locked state, where the first support is seated in the socket, and a folded state, where the first support is generally perpendicular to the first support's locked state, via the articulating mount; and a second support that secures a second portion of a firearm.

9. The gun vise of claim 8, wherein the first support comprises a post member and an end of the post member is received in the socket in the locked state.

10. The gun vise of claim 9, wherein the end of the post member is enlarged relative to the remainder of the post member.

11. The gun vise of claim 8, further comprising a frame, wherein the base is slidably mounted to the frame to expand or contract the horizontal distance between the first support and the second support.

12. The gun vise of claim 8, wherein the articulating mount comprises one or more pins and one or more corresponding slots at the socket.

13. The gun vise of claim 8, further comprising one or more risers protruding from the base, wherein the articulating mount is rotatable only when at the one or more risers.

14. The gun vise of claim 8, wherein the second support is movable between an unfolded state and a folded state generally perpendicular to the second support's unfolded state.

15. A method of securing a firearm with a gun vise comprising:

rotating a first support of the gun vise from a folded state to an extended state via an articulating mount;

moving the first support to a locked state via the articulating mount by sliding the first support into a socket of a base of the gun vise;

rotating a second support of the gun vise;

securing a first portion of the firearm with the first support; and securing a second portion of the firearm with a second support of the gun vise.

16. The method of claim 15, wherein a post member of the first support is received in the socket in the locked state.

17. The method of claim 15, further comprising sliding a base of the first support relative to a frame of the gun vise to expand or contract the horizontal distance between the first support and the second support.

18. The method of claim 17, further comprising sliding a base of the second support relative to the frame of the gun vise to expand or contract the horizontal distance between the first support and the second support.

19. The method of claim 15, wherein the articulating mount comprises one or more pins and one or more corresponding slots at the socket.

20. The method of claim 15, wherein the articulating mount is rotatable only when in the extended state.

* * * * *